US008855357B2

(12) United States Patent
Kajihara et al.

(10) Patent No.: US 8,855,357 B2
(45) **Date of Patent: *Oct. 7, 2014**

(54) SPEAKER DIAPHRAGM AND SPEAKER USING SAME, AND ELECTRONIC EQUIPMENT AND DEVICE USING SAID SPEAKER, AND SPEAKER DIAPHRAGM MANUFACTURING METHOD

(75) Inventors: Yoshimichi Kajihara, Mie (JP); Yohei Jin, Mie (JP); Toru Fujii, Shiga (JP)

(73) Assignee: Panasonic Corporation, Osaka (JP)

( * ) Notice: Subject to any disclaimer, the term of this patent is extended or adjusted under 35 U.S.C. 154(b) by 34 days.

This patent is subject to a terminal disclaimer.

(21) Appl. No.: 13/511,160

(22) PCT Filed: Jan. 12, 2011

(86) PCT No.: PCT/JP2011/000081

§ 371 (c)(1), (2), (4) Date: May 22, 2012

(87) PCT Pub. No.: WO2011/093008

PCT Pub. Date: Aug. 4, 2011

(65) Prior Publication Data

US 2012/0250930 A1 Oct. 4, 2012

(30) Foreign Application Priority Data

Jan. 27, 2010 (JP) ..... 2010-014964

(51) Int. Cl.

| | |
|---|---|
| ***H04R 1/00*** | (2006.01) |
| ***H04R 31/00*** | (2006.01) |
| ***H04R 7/12*** | (2006.01) |

(52) U.S. Cl.

CPC ..... *H04R 31/003* (2013.01); *H04R 2499/13* (2013.01); *H04R 7/12* (2013.01); *H04R 2307/021* (2013.01)

USPC ..... 381/428; 381/426; 181/167; 181/169

(58) Field of Classification Search

USPC ..... 381/426–428; 181/167–170; 162/141–149; 423/447.1–447.9

See application file for complete search history.

(56) References Cited

U.S. PATENT DOCUMENTS 2,560,379 A * 7/1951 Witchey ..... 381/430
3,649,776 A * 3/1972 Burton ..... 381/342

(Continued)

FOREIGN PATENT DOCUMENTS

CN 101213873 A 7/2008
JP 63-054100 A 3/1988

(Continued)

OTHER PUBLICATIONS

Chinese Search Report for Application No. 201180006187.0, dated Apr. 18, 2014.

*Primary Examiner* — Curtis Kuntz
*Assistant Examiner* — Ryan Robinson
(74) *Attorney, Agent, or Firm* — RatnerPrestia

(57) ABSTRACT

A diaphragm is formed of paper manufactured from a first fiber material and a second fiber material. The first fiber material is beaten to have a given freeness, and the second fiber material is made by carbonizing bamboo fiber that has been fibrillated into a microfibril state. This structure allows the second fiber material to increase a rigidity of the diaphragm and also increase an internal loss, so that sound quality of the speaker that employs this diaphragm can be improved.

9 Claims, 2 Drawing Sheets

(56) References Cited

U.S. PATENT DOCUMENTS

| | | | | | |
|---|---|---|---|---|---|
| 3,935,924 | A | * | 2/1976 | Nagao et al. | 181/169 |
| 4,017,694 | A | * | 4/1977 | King | 381/415 |
| 4,308,094 | A | * | 12/1981 | Miyoshi et al. | 162/218 |
| 4,412,103 | A | * | 10/1983 | Fujii et al. | 181/167 |
| 5,148,492 | A | * | 9/1992 | Uzawa et al. | 381/177 |
| 5,450,497 | A | * | 9/1995 | Paddock | 381/191 |
| 5,480,514 | A | * | 1/1996 | Suzuki | 162/231 |
| 5,581,053 | A | * | 12/1996 | Suzuki et al. | 181/167 |
| 6,980,664 | B2 | * | 12/2005 | Goller | 381/186 |
| 7,296,691 | B2 | * | 11/2007 | Koslow | 210/501 |
| 8,080,227 | B1 | * | 12/2011 | Goodell et al. | 423/447.9 |
| 8,340,342 | B2 | * | 12/2012 | Jin et al. | 381/428 |
| 2009/0080687 | A1 | | 3/2009 | Mimura et al. | |
| 2010/0027826 | A1 | | 2/2010 | Mimura et al. | |
| 2010/0172533 | A1 | | 7/2010 | Kajihara et al. | |
| 2011/0164764 | A1 | | 7/2011 | Jin et al. | |
| 2012/0145345 | A1 | | 6/2012 | Mimura et al. | |

FOREIGN PATENT DOCUMENTS

| | | | |
|---|---|---|---|
| JP | 2007-221635 | A | 8/2007 |
| JP | 2009-21897 | A | 1/2009 |
| JP | 2009-171386 | A | 7/2009 |

* cited by examiner

SPEAKER DIAPHRAGM AND SPEAKER USING SAME, AND ELECTRONIC EQUIPMENT AND DEVICE USING SAID SPEAKER, AND SPEAKER DIAPHRAGM MANUFACTURING METHOD

TECHNICAL FIELD

The present invention relates to a diaphragm of speakers to be used in a variety of audio equipment and video equipment, and electronic devices as well as automobiles, using the same diaphragm, such as speakers, stereos, and television receivers, and the present invention also relates to a method of manufacturing the same diaphragm of speakers.

BACKGROUND ART

In recent years digital technique has been widely used in electronic devices such as audio equipment as well as video equipment, so that the speakers to be used in these electronic devices are strongly required to have a better performance. The performance of a diaphragm of speakers is a crucial factor to determine the sound quality. It is thus an urgent need to develop a high-performance diaphragm that can achieve a better sound quality.

In the audio equipment industry or the automobile industry that uses audio equipment in automobiles, the sound quality of speakers has been dramatically improved according to the spread of digital devices. In these industries, speakers trend toward quality sound, light-weight, and environmentally friend. To pursue the quality sound, it is crucial to develop a diaphragm that satisfies users' acoustical need.

The diaphragm development has been focused on paper diaphragm, e.g. Patent Literature 1, because the paper diaphragm allows advantageously a more accurate control over the sound quality. Wood-pulp is used as the material for the paper diaphragm, and among the wood-pulp, craft pulp obtained by beating conifers is used. However, a shortage of the conifer has been accelerated by the extravagant use, so that used of an environmentally friend material is essential in the future.

The paper diaphragms many of which are formed of craft paper made from conifer have generally a lower rigidity than diaphragm formed of metal material or resin material. It is thus difficult for the paper diaphragm to improve the rigidity from the material view of point. The speaker employing the paper diaphragm is thus disadvantaged in clearer sound reproduction that is one of the factors in quality sound, as well as in larger output and in higher reliability.

RELATED ART LITERATURE

Patent Literature: Unexamined Japanese Patent Application Publication No. 2007-221635

DISCLOSURE OF INVENTION

The diaphragm of the present invention improves material rigidity, produces low-bass sound with firm feeling in a low register, and provides clear sound having less resonance peculiar to a high register and caused by lack of rigidity in the diaphragm. On top of that, the present invention allows the diaphragm to output larger sound and to be highly reliable. The diaphragm of the present invention is formed of a first fiber material and a second fiber material, the first fiber material is beaten to have a given freeness, and the second fiber material is obtained by carbonizing bamboo-fiber that has been fibrillated into a microfibril state, and the first and the second fiber materials are milled into the paper for the diaphragm. This structure allows the second fiber material to increase the rigidity and also increase internal loss, so that the sound quality of the speaker employing this diaphragm can be improved.

EMBODIMENT FOR PRACTICING THE INVENTION

Figure 1:
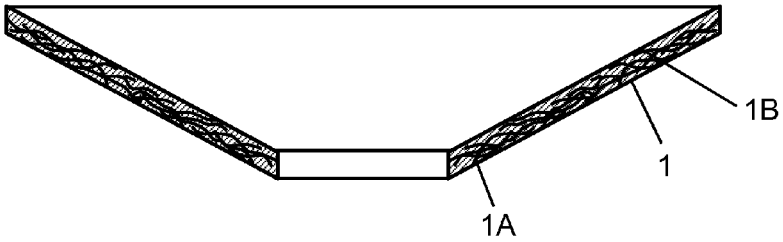
FIG. 1 is a schematic sectional view of a speaker diaphragm in accordance with an embodiment of the present invention.

FIG. 1 is a sectional view of a diaphragm in accordance with the embodiment of the present invention. Diaphragm 1 contains first fiber material 1A that is beaten to have a given freeness and second fiber material 1B that is obtained by carbonizing bamboo fiber fibrillated into a microfibril state. Diaphragm 1 can contain materials other than first and second fiber materials 1A and 1B, e.g. it can contain bamboo fiber. First fiber material 1A can employ bamboo fiber instead of conifer, whereby adverse affect to terrestrial environment can be decreased. Diaphragm 1 is made of paper manufactured from these materials.

FIG. 1 shows an outline of diaphragm 1 with straight lines, and for the convenience of description, it seems that spaces are available between the outlines, first fiber material 1A, and second fiber material 1B. However, in a case where diaphragm 1 is formed only of first fiber material 1A and second fiber material 1B, they are filled in places other than the places they are illustrated.

It is preferable that a freeness of first fiber material 1A is not greater than 650 cc. A freeness can be measured by a method specified under ISO 5267-2. A freeness of second fiber material 1B preferably is not greater than 15 cc. This combination of the degrees of beating allows improving the intertwining between the fibers. A freeness of the bamboo fiber that is fibrillated into a microfibril state can be measured practically 1 cc at best, so that the lower limit of a freeness of second fiber material 1B is 1 cc.

Second fiber material 1B preferably has an average fiber diameter of smaller than 5 μm. A smaller average fiber diameter allows improving the intertwining state of fibers. An average fiber diameter greater than 5 μm still allows providing diaphragm 1 with merits of bamboo fiber; however, it weakens the power to strengthen the intertwining. Meanwhile even the bamboo fiber is beaten into a microfibril state, its average fiber diameter can decrease to approx. 1 μm at best.

A ratio of average fiber length L to average fiber diameter D, i.e. L/D, is preferably equal to or greater than 10. A greater L/D allows improving the intertwining state of fibers. Even when the bamboo fiber is finely beaten into microfibril state, the L/D of bamboo fiber can be increased practically as much as approx. 2000. The upper limit of the L/B of second fiber material 1B is 2000.

Second fiber material 1B is preferably mixed into diaphragm 1 in an amount of not smaller than 5 wt % and not greater than 50 wt %. In a case of smaller than 5 wt %, the rigidity of diaphragm 1 increases a little. On the other hand, when second fiber material 1B is mixed into diaphragm 1 in an amount of greater than 50 wt %, water leakage is greatly lowered, so that the paper milling takes a longer time and the productivity is thus lowered.

In a case where first fiber material 1A includes the bamboo fiber fibrillated into the microfibril state, a total amount of second fiber material 1B and this bamboo fiber is mixed into diaphragm 1 preferably in an amount ranging from 5 wt % to 50 wt % (inclusive). The reason of this amount is the same as discussed previously.

The bamboo fiber used in this embodiment is not limited to a specific one as far as it originates in plant and has grown up and is aged longer than one year. A bamboo shoot or a young bamboo aged shorter than one year should be excluded. The bamboo aged longer than one year can maintain at minimum the rigidity and the sturdiness required in this embodiment, and the bamboo aged longer than two years improves the rigidity and the sturdiness. The bamboo aged longer than three years can further improves the rigidity and the sturdiness.

Second fiber material 1B is obtained by beating the foregoing bamboo fiber into the microfibril state and then carbonizing it. Material 1B thus increases its rigidity from a state before the carbonization, and as a result, diaphragm 1 increases the rigidity.

During the beating process, the average fiver length is little changed but the average fiber diameter is narrowed, so that the intertwining of fibers with each other, in particular, intertwining with other materials is strengthened. As a result, diaphragm 1 improves its rigidity and sturdiness.

During the carbonizing process, the bamboo fiber in the microfibril state is carbonized to such a degree that can provide diaphragm 1 with appropriate rigidity. To be more specific, the carbonizing process maintains the shape but increases the rigidity of the bamboo fiber. An excessive carbonization cannot maintain the shape as fiber, so that it is important to control a temperature and a time of the carbonizing process. For instance, heat treating at the temperature ranging from 500° C. to 1000° C. (inclusive) and for the time ranging from 24 hours to 120 hours (inclusive) will form second fiber material 1B suitable for diaphragm 1 of the speakers to be used for acoustic application or for vehicle equipment.

The carbonization discussed above allows the bamboo fiber to increase its elastic coefficient and internal loss, so that synergistic effect can be produced for the speakers to improve the sound quality. To be more specific, the sound can be reproduced more clearly, a low-bass sound with firm feeling in a low register can be reproduced, and a clear sound having less resonance peculiar to a high register and caused by lack of rigidity in the diaphragm can be reproduced. On top of that, a sound pressure in a high register is improved, and a reproduction band is widened.

As discussed above, use of first fiber material 1A and second fiber material 1B produces the following acoustic advantages: a sound pressure in the high register is improved, a clear and powerful sound is obtained in the high register, a low-bass sound with firm feeling is reproduced in a low register, and as a whole, a sound with high articulation, clear sonic contours, and excellence in auditory lateralization can be achieved.

On top of that, another advantage is obtained: A comparison with a diaphragm simply made of paper-pulp proves that diaphragm 1 is more excellent in quality and reliability because the sturdiness of diaphragm 1 is improved. Use of this diaphragm 1 allows a speaker to withstand a large input, and use of the speaker having this diaphragm 1 allows improving various reliabilities such as moist resistance that is an important factor to an in-car speaker. Diaphragm 1 thus allows the speaker to improve sound quality, to withstand a large output, and to increase the reliability. In addition to the foregoing advantages, use of the bamboo fiber reduces the cost and is friendly to terrestrial environment.

The bamboo fiber is beaten further, and this fiber is used as first fiber material 1A for being milled together with second fiber material 1B, whereby advantages of the bamboo fiber can be further exerted. If reinforcing materials other than the bamboo fiber is contained, they can be milled together with the bamboo fiber beaten into microfibril state, whereby the binding force can be strengthened and the advantages of the bamboo fiber can be exerted.

Before the manufacturing process of diaphragm 1, a fiber disintegration step can be prepared as a pre-process where fiber material is disintegrated for progressing in the degree of beating. This pre-process will improve the productivity even when the degree of beating has been progressed, and also achieves adjusting the sound quality with high accuracy. The effect of this pre-process is advantageous particularly at the use of the material having high rigidity such as the bamboo fiber.

To increase the strength of diaphragm 1 while the bamboo fiber, which is one of plant materials, is used, use of plant opal as reinforcement material will increase the elastic coefficient. The plant oval derived from the leaves of grass plants including bamboo.

Mica or aramid fiber can be used as the reinforcing material. Use of mica will increase the elastic coefficient and the internal loss, and use of aramid fiber will increase heat resistance and tensile strength. Two or more than two of the foregoing reinforcing materials can be used.

If necessary, additive such as sizing agent, paper strength additive, binder, waterproof agent, pigment, or dyestuff can be used. Polylactic acid and polyvinyl alcohol are compatible with the cellulose of bamboo fiber, so that they are easily fixed to the surface of bamboo fiber. They are also expected to increase the internal loss, and they can thus improve the frequency characteristics of the speaker.

Polylactic acid, in particular, is biodegradable plastic, so that the diaphragm made of bamboo fiber and polylactic acid is environmental harmonic and aids a speaker in being terrestrial environment friend. Use of the pigment, dyestuff, sizing agent, or paper strength additive is not specifically limited.

As discussed above, diaphragm 1 is made by milling first fiber material 1A together with second fiber material 1B, and the first fiber material 1A processed to have a given deeper degree, and the second fiber material 1B is bamboo fiber fibrillated into the microfibril state and then carbonized. The carbonized second fiber material 1B in particular allows diaphragm 1 to have a high internal loss while it still maintains high elastic coefficient.

Figure 2:
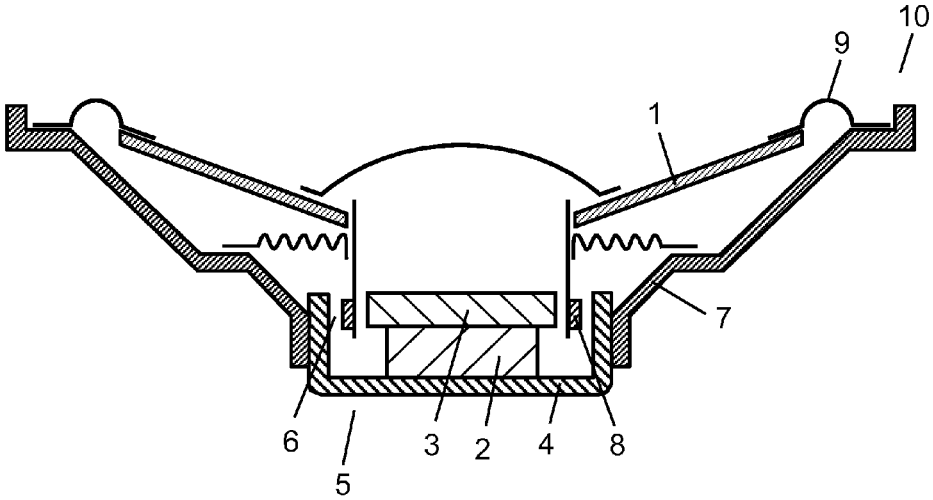
FIG. 2 is a sectional view of a speaker in accordance with an embodiment of the present invention.

The speaker using diaphragm 1 is demonstrated hereinafter with reference to FIG. 2 which is a sectional view of the speaker in accordance with this embodiment. Speaker 10 includes magnetic circuit 5, frame 7, diaphragm 1, and voice coil 8.

Internal-magnet type magnetic circuit 5 is formed of magnetized magnet 2 sandwiched by upper plate 3 and yoke 4. Frame 7 is joined to yoke 4 of magnetic circuit 5. Outer circumference of diaphragm 1 is bonded to a periphery of frame 7 via edge 9. In other words, frame 7 supports the outer circumference of diaphragm 1. A first end of voice coil 8 is joined to a center part of diaphragm 1, and a second end of voice coil 8 is inserted into magnetic gap 6. Parts of voice coil 8 are thus disposed within a working range of magnetic flux generated from magnetic circuit 5.

In the foregoing discussion, diaphragm 1 is used in speaker 10 having the internal-magnet type magnetic circuit 5; however, it can be used in a speaker having an outer-magnet type magnetic circuit.

Use of diaphragm 1 allows speaker 10 to improve the sound quality, to be more specific, the sound can be reproduced more clearly, a low-bass sound with firm feeling in a low register can be reproduced, and a clear sound having less resonance peculiar to a high register and caused by lack of rigidity in the diaphragm can be reproduced. On top of that, a sound pressure in a high register is improved, and a reproduction band is widened.

Figure 3:
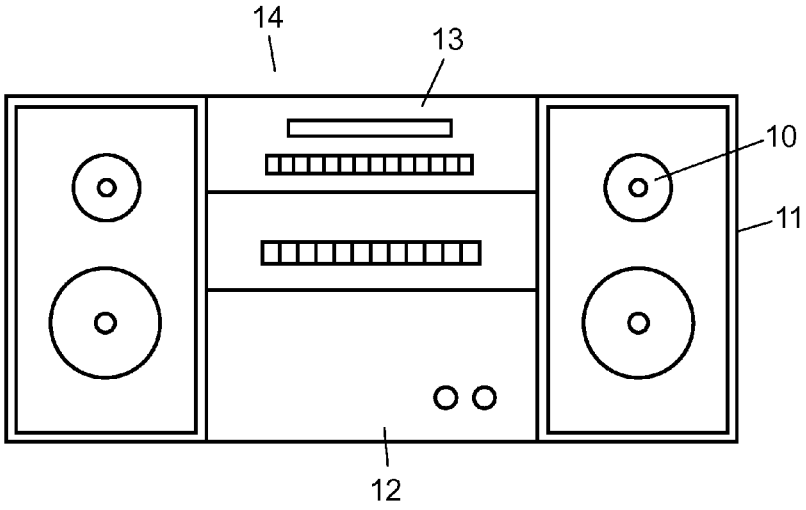
FIG. 3 shows an appearance of an electronic device in accordance with an embodiment of the present invention.

An electronic device employing speaker 10 is demonstrated hereinafter with reference to FIG. 3 which shows an appearance of a mini-component stereo system as a representative of the electronic device in accordance with this embodiment.

Speaker 10 is integrated into enclosure 11, thereby forming a speaker system. Amplifier 12 includes an amplifying circuit for electric signals supplied to the speaker system. Operating section 13 including a player outputs a source connected to amplifier 12. Mini-component stereo system 14 thus includes amplifier 12, operating section 13, and the speaker system. Amplifier 12, operating section 13, and enclosure 11 form a main body of mini-component stereo system 14. Amplifier 12 feeds voice coil 8 of speaker 10 with power, thereby generating a sound from diaphragm 1.

The foregoing structure achieves generating a sound of higher quality that conventional speakers have not achieved yet. To be more specific, the sound can be reproduced more clearly, a low-bass sound with firm feeling in a low register can be reproduced, and a clear sound having less resonance peculiar to a high register and caused by lack of rigidity in the diaphragm can be reproduced. On top of that, a sound pressure in a high register is improved, and a reproduction band is widened. As a result, mini-component stereo system 14 can reproduce music with quality sound.

Mini-component stereo system 14 is demonstrated hereinbefore as an application of speaker 10 to a device; however, the application is not limited to this example. Speaker 10 is also applicable to portable audio equipment and the like. It can be also used in a wide range of products including video equipment such as LCD television receiver or plasma display television receiver, and in an information communication device such as portable phone, and an electronic device such as a computer related device.

Figure 4:
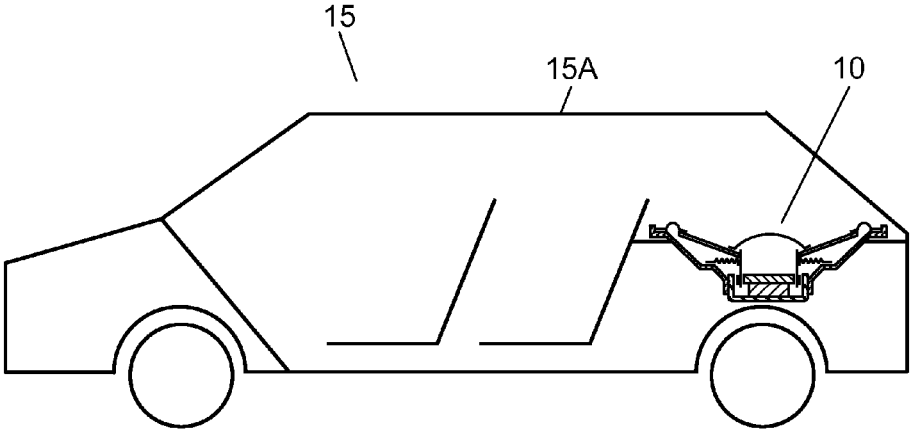
FIG. 4 is a sectional view of equipment in accordance with an embodiment of the present invention.

Equipment employing speaker 10 is demonstrated hereinafter with reference to FIG. 4 which is a sectional view of automobile 15 as a representative of the equipment in accordance with the embodiment. Speaker 10 is integrated into a rear tray or a front panel to be used as a part of car navigation system or a car audio system of automobile 15. In other words, automobile 15 has speaker 10 and mobile section 15A that includes speaker 10.

The foregoing structure allows generating a sound of higher quality through capitalizing on the advantage of speaker 10. To be more specific, the sound can be reproduced more clearly, a low-bass sound with firm feeling in a low register can be reproduced, and a clear sound having less resonance peculiar to a high register and caused by lack of rigidity in the diaphragm can be reproduced. On top of that, a sound pressure in a high register is improved, and a reproduction band is widened. As a result, the equipment, e.g. automobile 15, employing speaker 10 can improve the sound quality.

INDUSTRIAL APPLICABILITY

The speaker diaphragm, speaker using this diaphragm, electronic device and equipment employing this speaker of the present invention are useful for electronic devices such as an audio device and a video device, information communication devices, and equipment such as an automobile that need better sound quality and environmental friend properties.

DESCRIPTION OF REFERENCE MARKS

1 diaphragm
1A first fiber material
1B second fiber material
2 magnet
3 upper plate
4 yoke
5 magnetic circuit
6 magnetic gap
7 frame
8 voice coil
9 edge
10 speaker
11 enclosure
12 amplifier
13 operating section
14 mini-component stereo system
15 automobile
15A mobile section

The invention claimed is:

1. A speaker diaphragm made of paper manufactured from a material comprising:
- a first fiber material beaten to have a given freeness; and
- a second fiber material made by carbonizing bamboo fiber fibrillated into a microfibril state,
- wherein the second fiber material is beaten to have a given freeness not greater than 15 cc,
- the second fiber material is contained in the speaker diaphragm by a content ranging from 5 wt % to 50 wt %,
- the second fiber material has an average fiber diameter of smaller than 5 μm and not smaller than 1 μm,
- a ratio of an average fiber length to an average fiber diameter is equal to or greater than 10 and equal to or less than 2000, and
- carbonization temperature ranges from 500° C. to 1000° C. and carbonization time ranges from 24 hours to 120 hours.

2. The speaker diaphragm of claim 1, wherein the first fiber material includes bamboo fiber fibrillated into a microfibril state, and a total content of the second fiber material and the bamboo fiber contained in the first fiber material ranges from 5 wt % to 50 wt %.

3. The speaker diaphragm of claim 1, further comprising, as a reinforcement material, plant opal derived from leaves of grass plants including bamboo.

4. The speaker diaphragm of claim 1 further comprising, as a reinforcement material, at least one of mica and aramid fiber.

5. A speaker comprising:
- a magnetic circuit;
- a frame coupled to the magnetic circuit;
- the speaker diaphragm as defined in claim 1; and
- a voice coil coupled to the diaphragm,
- wherein the frame supports an outer circumference of the diaphragm, and a part of the voice coil is disposed within a working range of magnetic flux generated from the magnetic circuit.

6. An electronic device comprising:

the speaker as defined in claim 5; and a main body for feeding the speaker with power.

7. Equipment comprising:

the speaker as defined in claim 5; and a moving section including the speaker.

8. A method of manufacturing a speaker diaphragm, the method comprising:

preparing a first fiber material processed to have a given freeness and a second fiber material formed by carbonizing bamboo fiber fibrillated into a microfibril state; and milling a material including at least the first fiber material and the second fiber material into paper and forming the paper, wherein the second fiber material has an average fiber diameter of smaller than 5 μm and not smaller than 1 μm, a ratio of an average fiber length to an average fiber diameter is equal to or greater than 10 and equal to or less than 2000, and carbonization temperature ranges from 500° C. to 1000° C. and carbonization time ranges from 24 hours to 120 hours.

9. The method of manufacturing the speaker diaphragm of claim 8, further comprising:

disintegrating a fiber material, as a pre-process, for preparing the first fiber material.

* * * * *